US005906114A

United States Patent [19]

Rissin

[11] Patent Number: 5,906,114

[45] Date of Patent: May 25, 1999

[54] EARRING STABILIZER

[76] Inventor: Joseph B. Rissin, 2760 1st Pl., Baldwin, N.Y. 11510

[21] Appl. No.: 08/846,855

[22] Filed: May 1, 1997

[51] Int. Cl.[6] ..... A44C 25/00

[52] U.S. Cl. ..... 63/33; 63/12; 63/14.1

[58] Field of Search ..... 63/33, 12, 13, 63/14.1, 14.2

[56] References Cited

U.S. PATENT DOCUMENTS 3,630,048 12/1971 Masters ..... 63/12

4,688,400 8/1987 Chioffe ..... 63/12

5,044,176 9/1991 King ..... 63/12

*Primary Examiner*—Kien T. Nguyen

*Attorney, Agent, or Firm*—Michael J. Brown

[57] ABSTRACT

An earring stabilizer for assisting in the support of an earring, especially for use with earrings for pierced ears. The stabilizer comprises an extension bar and a contact member, where the contact member preferably presents a concave surface for a comfortable fit adjacent to the eminentia conchae of the wearer's ear. The stabilizer is designed to attach to the earring behind the wearer's ear, where the earring is supported on the lobule of the ear.

13 Claims, 2 Drawing Sheets

FIG. 1
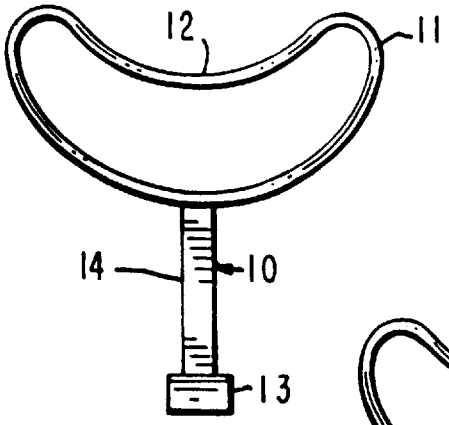
FIG. 2
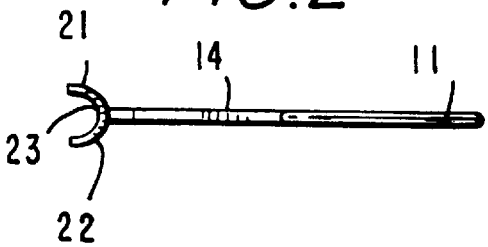
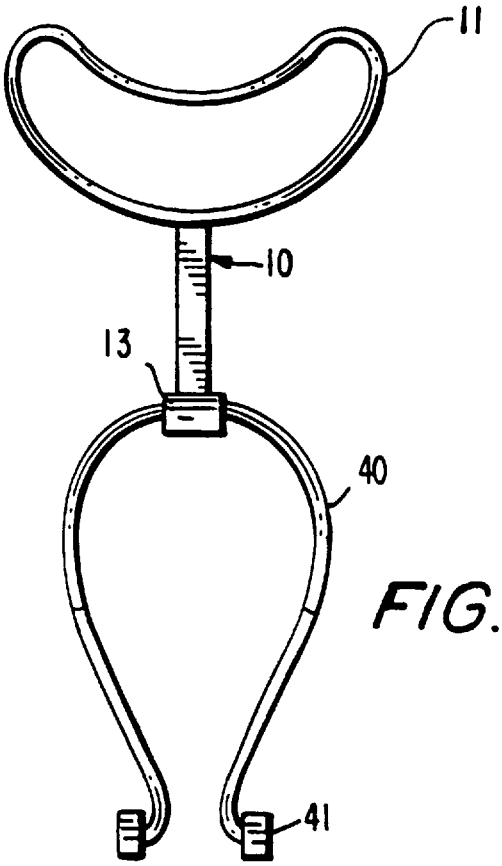
FIG. 3a
FIG. 3b
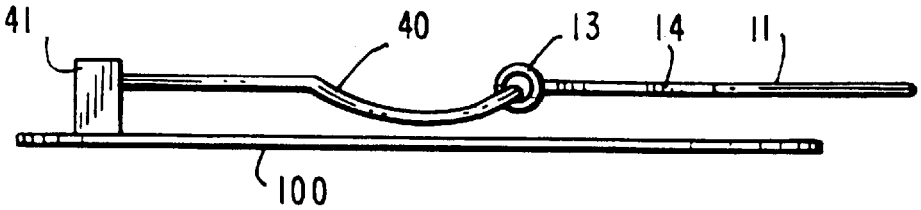

EARRING STABILIZER

FIELD OF THE INVENTION

The invention relates to the field of jewelry, specifically earrings and earring supports.

DISCUSSION OF RELATED ART

Earrings are commonly worn jewelry or decorations, usually supported on an ear. The two most common methods of supporting an earring on a person's ear are the post and the clip-on supports.

The clip-on type of earring is known to comprise an elongated clip which moves between an open position and a closed position, pivoting on a hinge. In the closed position, the end of the elongated clip opposite from the hinge is located near the back of the earring, such that when the earring is placed on the ear of the wearer, part of the ear, usually the lobule, is compressed between the end of the elongated clip and the back of the earring, holding the earring in place on the ear.

With the post support, a post penetrates a previously pierced hole in the auricle of an ear, usually in the lobule. One end of the post is attached to the back of the earring, and the other end of the post is free to penetrate the wearer's ear. The post is often secured by a nut or clip. An earring nut is usually made of a resilient material, with a hole for receiving the earring post. The nut usually comprises means for removably engaging the end of the post. The resilient material is often metal, and where the earring comprises precious and non-precious metals or materials, the nut usually comprises similar or identical metals or materials.

The earring clip for a post support is also made of a resilient material and commonly appears in a loop or "omega" shape. The clip is attached to the back of the earring at a point near the post, where the attachment of the clip is by a hinge. The clip usually moves between two positions, an open position, where the clip is roughly perpendicular to the back of the earring, and a closed position, where the clip surrounds the post and is roughly parallel to the back of the earring. Where the clip is a loop or "omega" shape, the ends of the clip are rotatably attached to the back of the earring to form the hinge.

One problem with existing earrings is that the primary support for the earrings relies upon the lobule of the ear. The lobule is made of adipose tissue and is relatively soft and pliable. Earrings supported by the lobule are designed to depend or extend out from the support point, so as to present a pleasant appearance. Where earrings are made with a significant portion of their mass located above the support point, such earrings may be "top heavy." With such "top heavy" earrings, the higher weight forces the lobule to bend, resulting in the earring being worn at an angle and detracting from the appearance of the earring.

Earrings supported by the auricle of the ear either require piercing of the cartilage of the auricle, or otherwise attaching the earring to the auricle. A majority of earring designs, however, do not rely upon the auricle for support.

OBJECTS OF THE INVENTION

It is an object of the present invention to provide a stabilizer for earrings, allowing earrings to have a substantially vertical orientation when being worn.

It is an object of the present invention to allow earrings which would otherwise be considered "top-heavy" to be worn where the earrings maintain a substantially vertical orientation.

It is an object of the present invention to provide a support for earrings, allowing earrings of greater weight and dimension to be worn.

It is an object of the present invention to provide a comfortable means for supporting earrings.

SUMMARY OF THE INVENTION

The present invention provides a stabilizer for earrings, and is especially suited for earrings worn on pierced ears. The stabilizer is mounted on an earring retaining means, such as a clip or nut, and extends toward the eminentia conchae of the wearer's ear. The stabilizer comprises an elongated bar, attached at one end to the earring retaining clip or nut, with a stabilizing member at the other end of the bar. The stabilizing member preferably comprises a concave surface where it is proximate to the wearer's eminentia conchae.

BRIEF DESCRIPTION OF THE DRAWINGS

FIG. 1 is a top view of a preferred embodiment of the earring stabilizer.

FIG. 2 is a side view of the earring stabilizer.

FIG. 3*a* is a top view of the earring stabilizer mounted upon a retaining clip.

FIG. 3*b* is a side view of the earring stabilizer mounted upon a retaining clip.

DETAILED DESCRIPTION

Figure 4A:
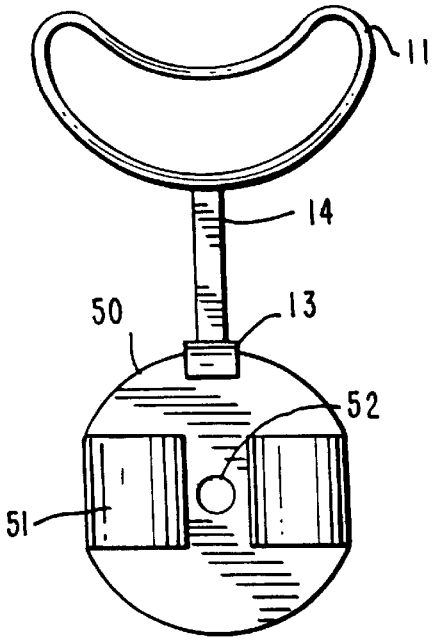
FIG. 4*a* is a top view of the earring stabilizer mounted on a common form of earring nut.
Figure 4B:
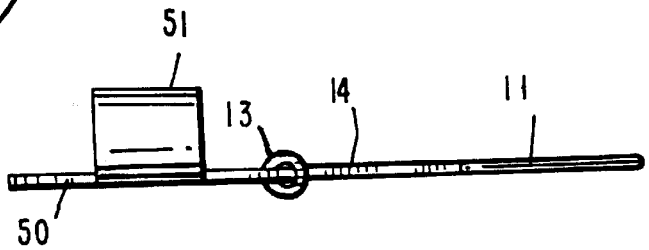
FIG. 4*b* is a side view of the earring stabilizer mounted on a common form of earring nut.
Figure 5:
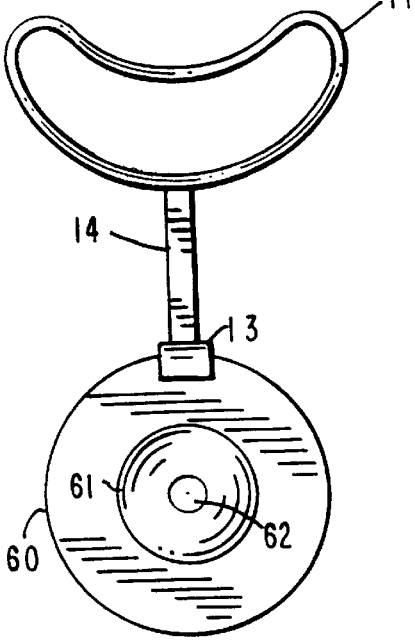
FIG. 5 is a top view of the earring stabilizer mounted on an alternate form of earring nut.
Figure 6:
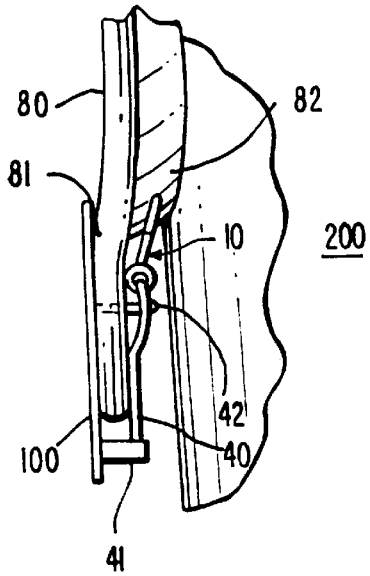
FIG. 6 is a rear view of an ear, showing an earring with the earring stabilizer mounted on a retaining clip.

In a preferred embodiment of the invention, the earring stabilizer 10 is comprised of an extension bar 14, a stabilizing member, such as loop 11, and a mount 13. The stabilizer 10 is preferably composed of metal and can be made of the same material as the earring to provide an aesthetically pleasing appearance.

The extension bar 14 is preferably straight and may be of any length. A preferred length of the extension bar 14 is approximately ⅛ of an inch, however the length can be varied to accommodate different ear sizes and shapes. Mount 13 is attached to one end of the extension bar 14 and the stabilizing member is attached to the other end of extension bar 14.

The stabilizing loop 11 has a concave edge 12 for engaging the eminentia conchae 82 of the wearer's ear. Preferably, the width of the stabilizing loop 11 is approximately ⅜ of an inch. However, the width may be of any size, preferably less than the width of the wearer's ear. Where the width is narrow as to present a pointed surface adjacent to the wearer's ear, there may be discomfort for the wearer. The height of the stabilizing loop 11 may also vary to accommodate the size and shape of the wearer's ear and to provide a comfortable fit.

Alternatively, the stabilizing member may comprise a stabilizing bar attached at its middle to an end of extension bar 14. A preferred embodiment of the stabilizing bar is curved, where the combination of the extension bar and the stabilizing bar presents a "Y" shape. Other embodiments of the stabilizing member may be a flat disc, a sphere, or other shapes which may comfortably contact the wearer of the earring.

Yet another embodiment of the stabilizer omits the extension bar, where mount 13 is attached directly to the stabilizing member.

With a common earring 100, which comprises a post 42, a retaining clip 40 and a clip hinge 41, the post 42 penetrates through a previously pierced hole in the wearer's ear, usually through lobule 81. The hole may also be previously pierced through the auricle 80 of the ear. The earring stabilizer 10 is preferably mounted on retaining clip 40 to extend toward the wearer's eminentia conchae 82.

The mount 13 is preferably formed of arms 21 and 22, where the juncture of the arms 21 and 22 forms a notch 23. Arms 21 and 22 are preferably pliant. In mounting the stabilizer on a retaining clip 40, an edge or surface of earring clip 40 is inserted into notch 23. Arms 21 and 22 are moved into a position around the inserted edge or surface and secured upon the edge or surface. The stabilizer is mounted in a similar fashion on earring nuts 50 and 60.

The material of the earring clip 40 is normally a resilient metal, under tension from being bowed into shape. It is known in the art that exposure to high levels of heat reduce or remove the resilient feature of the metal clip. Similarly, the retention means of earring nuts 50 and 60 may also be comprised of resilient metals, under tension. While, soldering methods using precious metals such as gold or platinum often require very high temperatures, it is known that those same temperatures may detrimentally affect the resilient quality of the earring support. Therefore, the mount 13 is preferably secured upon earring clip 40 or earring nuts 50 and 60 using a low temperature or soft solder technique.

Using the low temperature solder technique, a mix of primarily tin with trace silver is melted at approximately 450 degrees Fahrenheit. Preferably the solder mix is 96% tin with 4% silver. The solder is melted and applied to at least one of notch 23, arms 21 and 22, and earring clip 40 or earring nuts 50 and 60. The molten solder fixedly joins mount 13 to the earring clip 40 or earring nuts 50 and 60.

The earring stabilizer may also be attached to the earring by use of an adhesive or epoxy.

The earring stabilizer may also be mounted on other types of earrings as are known in the art, including the clip-on and the screw types, which rely upon compression of the ear to support the earring.

With a clip-on earring, the earring stabilizer is affixed to an edge of the clip, similar fashion to how the stabilizer would be affixed to the retaining clip of the post type of earring.

The screw type of earring is known to comprise an arm extended from the earring, which arm extends around the lobule, an threaded opening at the end of the arm, a threaded shaft, with a head for engaging the lobule, where the threaded shaft engages the opening in the arm extended from the earring. Opposite of the head of the threaded shaft, usually on the back of the earring itself, is a flat surface. In use, the lobule is compressed between the flat surface and the head of the threaded shaft. The compression is achieved by rotating the threaded shaft to bring the head closer to the flat surface.

The earring stabilizer may be mounted on either the head of the threaded shaft, or on the arm extended from the earring. Where the stabilizer is mounted on the head of the threaded shaft, it is preferred that the head be rotatably attached to the threaded shaft, so that the mounted stabilizer may be consistently directed as desired.

To aid in the comfort feature of the earring stabilizer, the stabilizing member, be it loop 11 or an other shape, may be covered in plastic, rubber, cloth, or any other material known to be comfortable against the skin. The covering material may be applied either before or after the earring stabilizer is attached to the earring.

While certain novel features of this invention have been shown and described, it will be understood that various omissions, substitutions and changes in the forms and details of the device illustrated and in its operation can be made by those skilled in the art without departing from the spirit of the invention.

I claim:

1. A stabilizer for an earring, the earring comprising an elongated support post and retaining means, where the elongated support post has a first end attached to the earring and a second end capable of penetrating a previously existing aperture in an ear of a wearer, and where the retaining means comprises a hinged loop clip with an edge located opposite from a hinge, the hinged loop clip capable of movement between an open position and a closed position, where the hinged loop clip in the closed position is capable of compressing a lobule of a wearer's ear, and where the hinged loop clip is capable of engaging the second end of the elongated support post, the stabilizer comprising an elongated strut with a first end capable of attachment to the edge of the hinged loop clip of the retaining means, and a second end; and a stabilizing member, with a contact edge and an attachment edge, where the attachment edge is attached to the second end of the elongated strut.

2. The stabilizer of claim 1, where the contact edge of the stabilizing member comprises a concave edge.

3. The stabilizer of claim 1, where the contact edge of the stabilizing member comprises an arc.

4. The stabilizer of claim 1, where the contact edge of the stabilizing member comprises a concave surface.

5. The stabilizer of claim 1, where the length of the earring stabilizer extending from a point of attachment on the retaining means comprises a length sufficient to extend from the retaining means to the eminentia conchae of the wearer's ear.

6. The stabilizer of claim 5, where the length of the earring stabilizer is approximately ⅛ of an inch.

7. The stabilizer of claim 1, where the stabilizing member is capable of contacting the ear of the wearer near the eminentia conchae of the ear.

8. The stabilizer of claim 1, where the first end of the elongated strut is capable of being attached to the retaining means using a low temperature solder.

9. A stabilizer for an earring, the earring comprising an ornament side and retaining means, where the retaining means comprises a hinged clip with an edge located opposite from a hinge, the hinged clip capable of movement between an open position and a closed position, where the hinged clip in the closed position is capable of compressing a lobule of the wearer's ear, and where the earring is supported on a lobule of an ear of a wearer by the compression of the lobule between the ornament side and the retaining means, the stabilizer comprising an elongated strut, with a first end capable of attachment to the retaining means; and a stabilizing member attached to a second end of the elongated strut.

10. The stabilizer of claim 9, where the stabilizing member is capable of contacting the ear of the wearer near the eminentia conchae of the ear.

11. The stabilizer of claim 9, where the first end of the elongated strut is capable of being attached to the edge of the hinged clip.

12. A stabilizer for an earring, the earring comprising an elongated support post and retaining means, where the elongated support post has a first end attached to the earring and a second end capable of penetrating a previously existing aperture in an ear of a wearer, and where the retaining means comprises a center opening and an edge, where the center opening of the retaining means is capable of engaging the second end of the elongated support post, the stabilizer comprising an elongated stabilizing member capable of attachment to the retaining means, where the elongated stabilizing member comprises a contact edge which is located a fixed distance from the retaining means, and in a direction from the retaining means toward the eminentia conchae of an ear when the earring is supported on the lobule of the ear.

13. The stabilizer of claim 12, where the contact edge presents a concave edge directed toward the eminentia conchae of the wearer's ear.

* * * * *